US008906167B2

(12) United States Patent
Baldwin et al.

(10) Patent No.: US 8,906,167 B2
(45) Date of Patent: Dec. 9, 2014

(54) SLIDE ASSEMBLY FOR A DISHWASHER RACK

(75) Inventors: Mark W. Baldwin, Saint Joseph, MI (US); Rexford W. Cordill, Granger, IN (US); Jeffrey R. Taylor, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1261 days.

(21) Appl. No.: 12/768,954

(22) Filed: Apr. 28, 2010

(65) Prior Publication Data

US 2011/0266935 A1 Nov. 3, 2011

(51) Int. Cl.
*A47L 15/50* (2006.01)

(52) U.S. Cl.
CPC ..... *A47L 15/507* (2013.01)
USPC ..... 134/56 D; 134/137; 312/334.1

(58) Field of Classification Search
USPC ..... 134/56 D
See application file for complete search history.

(56) References Cited

U.S. PATENT DOCUMENTS

| | | | | |
|---|---|---|---|---|
| 1,475,907 | A | 11/1923 | Volman | |
| 1,618,412 | A | 2/1927 | Dorward | |
| 3,342,098 | A | 9/1967 | Schuplin | |
| 3,594,058 | A | 7/1971 | Kauffman | |
| 3,776,031 | A | 12/1973 | Trigg | |
| 5,417,489 | A | 5/1995 | Compagnucci | |
| 5,688,066 | A | 11/1997 | Loose | |
| 5,779,085 | A | 7/1998 | Havlinek et al. | |
| 5,988,778 | A | 11/1999 | Lammens | |
| 7,032,932 | B2 | 4/2006 | Guest | |
| 7,281,704 | B2 * | 10/2007 | Salice | 267/124 |
| 2005/0150523 | A1 * | 7/2005 | Schock | 134/25.2 |
| 2009/0096338 | A1 * | 4/2009 | Jahrling | 312/334.5 |
| 2010/0051067 | A1 * | 3/2010 | Dalsing | 134/46 |

FOREIGN PATENT DOCUMENTS

| | | | | |
|---|---|---|---|---|
| CN | 201057883 | Y | 5/2008 | |
| CN | 201135260 | Y | 10/2008 | |
| DE | 10248512 | A1 | 4/2004 | |
| EP | 1221559 | A2 | 7/2002 | |
| EP | 1444921 | A1 | 8/2004 | |
| EP | 1925240 | A1 | 5/2008 | |
| GB | 2416670 | A | 2/2006 | |
| JP | 2005230468 | A | 9/2005 | |
| JP | 200832206 | A | 2/2008 | |
| JP | 2009106527 | A | 5/2009 | |
| WO | WO2010/012572 | A1 * | 2/2010 | A47L 15/50 |

* cited by examiner

*Primary Examiner* — Michael Barr
*Assistant Examiner* — Jason Riggleman

(57) ABSTRACT

A dishwasher includes a tub having a retractable upper dish rack secured to the tub by a slide assembly. The slide assembly includes a pair of telescoping cylinder assemblies, each of which includes a number of hollow, cylindrical, metal rods.

18 Claims, 8 Drawing Sheets

SLIDE ASSEMBLY FOR A DISHWASHER RACK

TECHNICAL FIELD

The present disclosure relates generally to a dishwasher, and more particularly to a slide assembly for a dishwasher rack of a dishwasher.

BACKGROUND

A dishwasher is a domestic appliance into which dishes and other cooking and eating wares (e.g., plates, bowls, glasses, flatware, pots, pans, bowls, etcetera) are placed to be washed. A dishwasher includes a number of dish racks which support such wares. During a cleaning cycle, the dishwasher sprays wash fluid (i.e., water and/or a wash chemistry) on the wares in the dish racks.

SUMMARY

According to one aspect, a dishwasher includes a tub defining a washing chamber. A first pair of cylindrical rods is secured to the tub. The first pair of cylindrical rods includes a first right rod and a first left rod. A second right rod is telescoped to the first right rod, and a second left rod is telescoped to the first left rod. A right rack connector is secured to the second right rod and a left rack connector is secured to the second left rod. A dish rack has its right side secured to the right rack connector and its left side secured to the left rack connector.

The cylindrical axis of the first right rod is collinear with the cylindrical axis of the second right rod. The cylindrical axis of the first left rod is collinear with the cylindrical axis of the second left rod.

A third right rod may be telescoped to the second right rod, and a third left rod may be telescoped to the second left rod.

The cylindrical axes of each of the first right rod, the second right rod, and the third right rod are collinear with one another, whereas the cylindrical axes of each of the first left rod, the second left rod, and the third left rod are collinear with one another.

A pair of guide rails is secured to a top wall of the tub. A right carrier may be positioned in the right guide rail of the pair of guide rails so as to slide within the right guide rail. The first right rod is secured to the right carrier. A left carrier may be positioned in the left guide rail of the pair of guide rails so as to slide within the left guide rail. The first left rod is secured to the left carrier.

A rear cross brace is secured to both the right carrier and the left carrier. A front cross brace is secured to both the second right rod and the second left rod.

According to another aspect, a dishwasher includes a tub defining a washing chamber. A right cylinder assembly is secured to the tub. The right cylinder assembly has a number of telescoping cylindrical rods each of which has a cylindrical axis that is collinear with one another. A left cylinder assembly is also secured to the tub. The left cylinder assembly includes a number of telescoping cylindrical rods each of which has a cylindrical axis that is collinear with one another. A right rack connector is secured to right cylinder assembly and a left rack connector secured to the left cylinder assembly. A dish rack has its right side secured to the right rack connector and its left side secured to the left rack connector.

The right cylinder assembly may include three cylindrical rods, with the left cylinder assembly likewise including three cylindrical rods.

A pair of guide rails is secured to a top wall of the tub. A right carrier may be positioned in the right guide rail of the pair of guide rails so as to slide within the right guide rail. The right cylinder assembly is secured to the right carrier. A left carrier may be positioned in the left guide rail of the pair of guide rails so as to slide within the left guide rail. The left cylinder assembly is secured to the left carrier.

A rear cross brace is secured to both the right carrier and the left carrier. A front cross brace is secured to both the right cylinder assembly and the left cylinder assembly.

According to another aspect, a dishwasher includes a tub defining a washing chamber. The tub has a top wall. A pair of guide rails is secured to a top wall of the tub. The pair of guide rails includes a right guide rail and a left guide rail. A right carrier is positioned in the right guide rail so as to slide within the right guide rail. A left carrier is positioned in the left guide rail so as to slide within the left guide rail. A right cylinder assembly is secured to the right carrier. The right cylinder assembly includes a number of telescoping cylindrical rods each of which has a cylindrical axis that is collinear with one another. A left cylinder assembly is secured to the left carrier. The left cylinder assembly includes a number of telescoping cylindrical rods each of which has a cylindrical axis that is collinear with one another. A dish rack has a right side thereof secured to the right cylinder assembly and the left side thereof secured to the left cylinder assembly.

The right cylinder assembly may include three cylindrical rods, with the left cylinder assembly likewise including three cylindrical rods.

A rear cross brace is secured to both the right carrier and the left carrier. A front cross brace is secured to both the right cylinder assembly and the left cylinder assembly.

BRIEF DESCRIPTION OF THE DRAWINGS

The detailed description particularly refers to the following figures, in which.

DETAILED DESCRIPTION OF THE DRAWINGS

Figure 1:
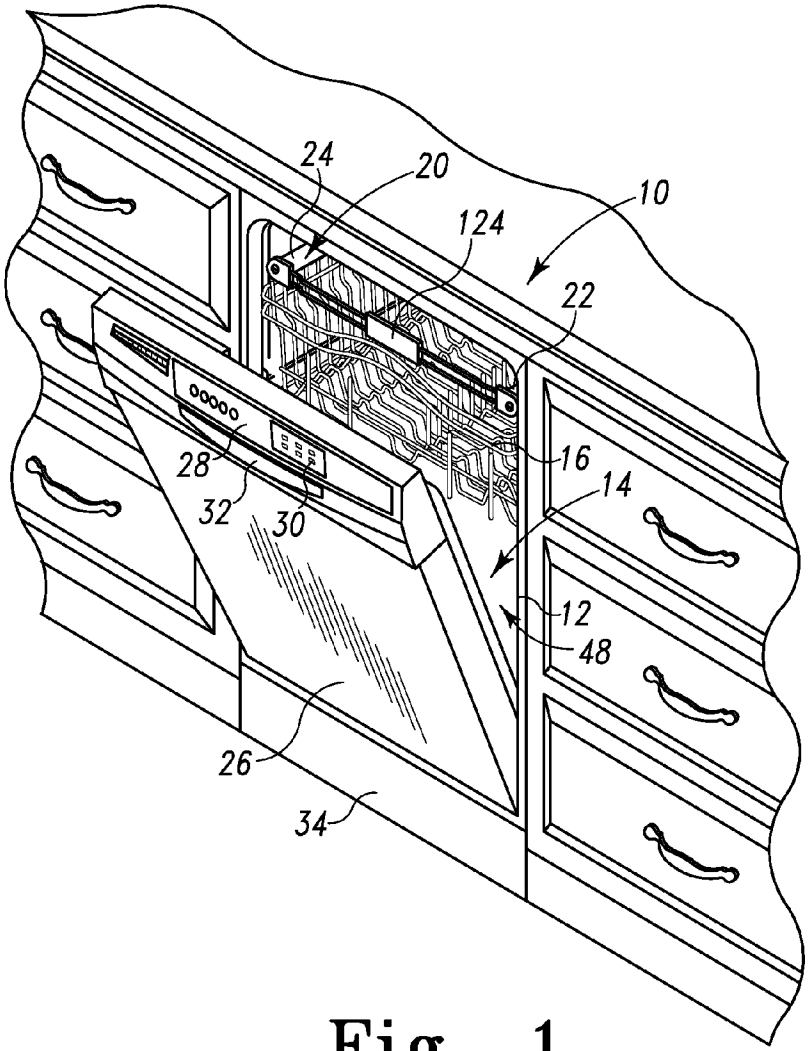
FIG. 1 is fragmentary perspective view showing a dishwasher installed in a kitchen.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a dishwashing machine 10 (hereinafter dishwasher 10) is shown. The dishwasher 10 includes a tub 12 that defines a washing chamber 14 into which a user may place dishes and other cooking and eating wares (e.g., plates, bowls, glasses, flatware, pots, pans, bowls, etc.) to be washed. The dishwasher 10 includes an upper dish rack 16 and a lower dish rack (not shown). As will be discussed below in greater detail, a slide assembly 20 is positioned between the upper dish rack 16 and the tub 12. The slide assembly 20 includes a pair of telescoping cylinder assemblies 22, 24 that allow the dish rack 16 to extend from and retract into the tub 12, which facilitates the loading and unloading of the dish rack 16. Use of the telescoping cylinder assemblies significantly reduces the amount of side-to-side and up-and-down movement or "play" of the dish rack relative to conventional slide assemblies that utilize rollers or sliding rails secured to the side walls of the tub.

A door 26 is hinged to the lower front edge of the tub 12. The door 26 permits user access to the tub 12 to load and unload the dishwasher 10. The door 26 also seals the front of the dishwasher 10 during a wash cycle. A control panel 28 is located at the top of the door 26. The control panel 28 includes a number of controls 30, such as buttons and knobs, which are used to control the operation of the dishwasher 10. A handle 32 is located on the door 26. The user may use the handle 32 to pull the door 26 open. It should be appreciated that the handle 32 shown in FIG. 1 is but one of many different types of handles that could be used.

A machine compartment 34 is located below the tub 12. The machine compartment 34 is sealed from the tub 12. In other words, unlike the tub 12, which is filled with fluid and exposed to spray during the wash cycle, the machine compartment 34 does not fill with fluid and is not exposed to spray during the operation of the dishwasher 10. The machine compartment 34 houses components such as the dishwasher's fluid pump(s) and valve(s), along with the associated wiring and plumbing.

Figure 2:
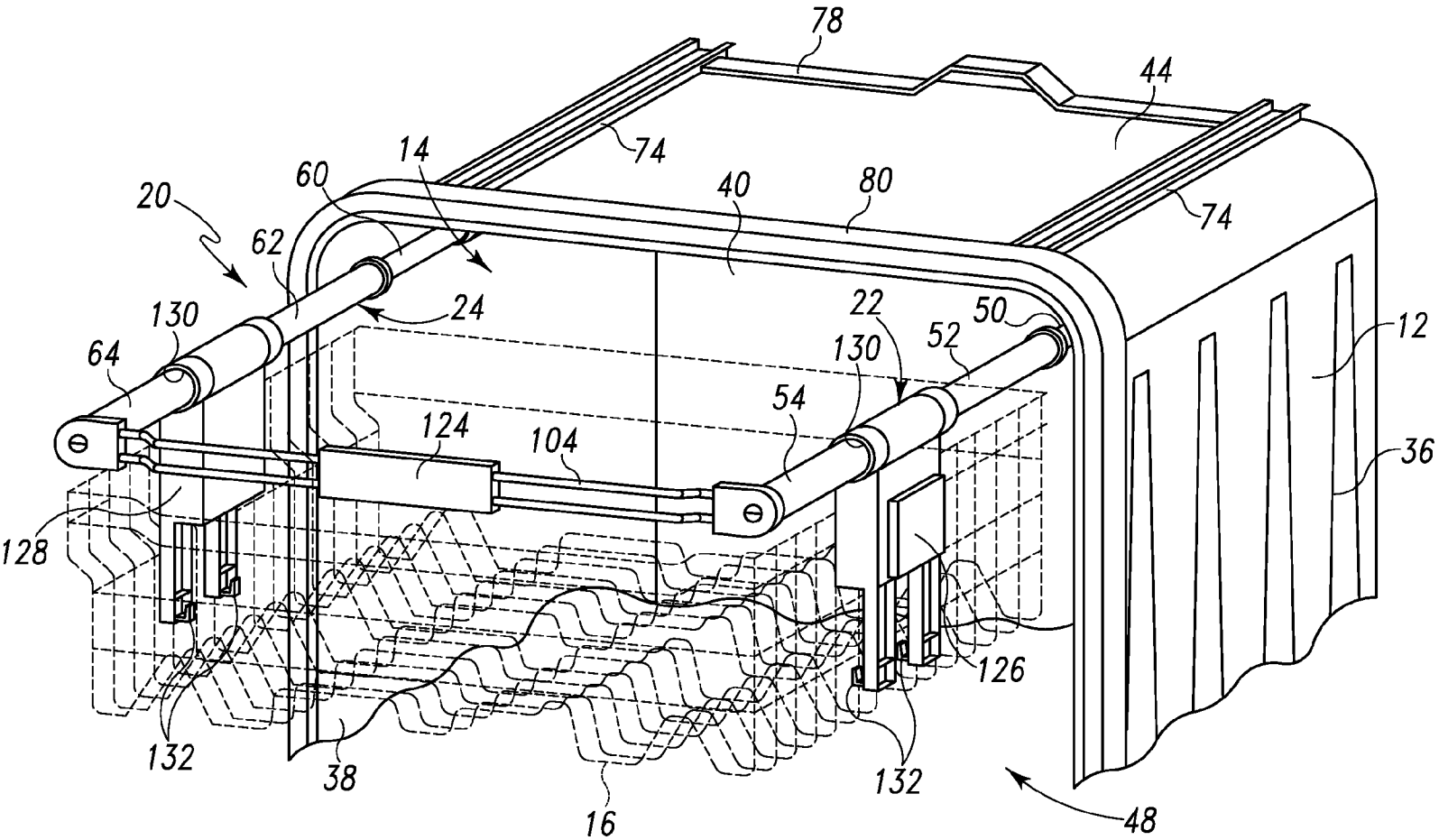
FIG. 2 is fragmentary perspective view of the tub of the dishwasher.
Figure 3:
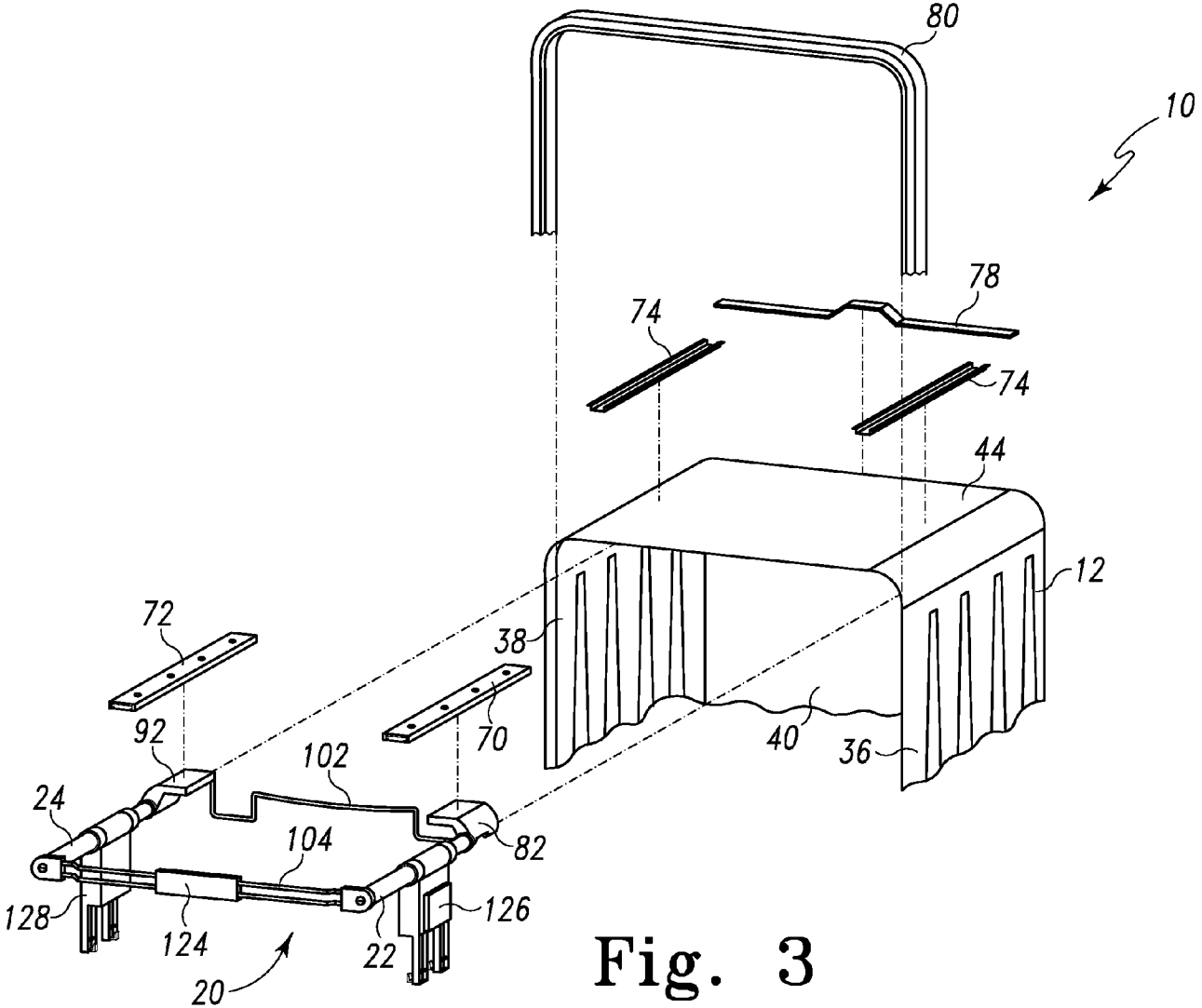
FIG. 3 is an exploded fragmentary view of showing the slide assembly of the dishwasher removed from the tub.

Referring now to FIG. 2, the tub 12 and the slide assembly 20 of the dishwasher 10 are shown in greater detail. The tub 12 includes a pair of side walls 36, 38 and a back wall 40 that extend upwardly from its bottom wall (not shown) to a top wall 44, thereby defining the washing chamber 14. The open front side of the tub 12 defines an access opening 48, which provides the user with access to the dish rack 16 positioned in the washing chamber 14 when the door 26 is open. When the door 26 is closed, the door 26 seals the access opening 48, thereby preventing the user from accessing the dish rack 16. The door 26 also prevents fluid from escaping through the access opening 48 of the dishwasher 10 during a dishwashing cycle.

Figure 4:
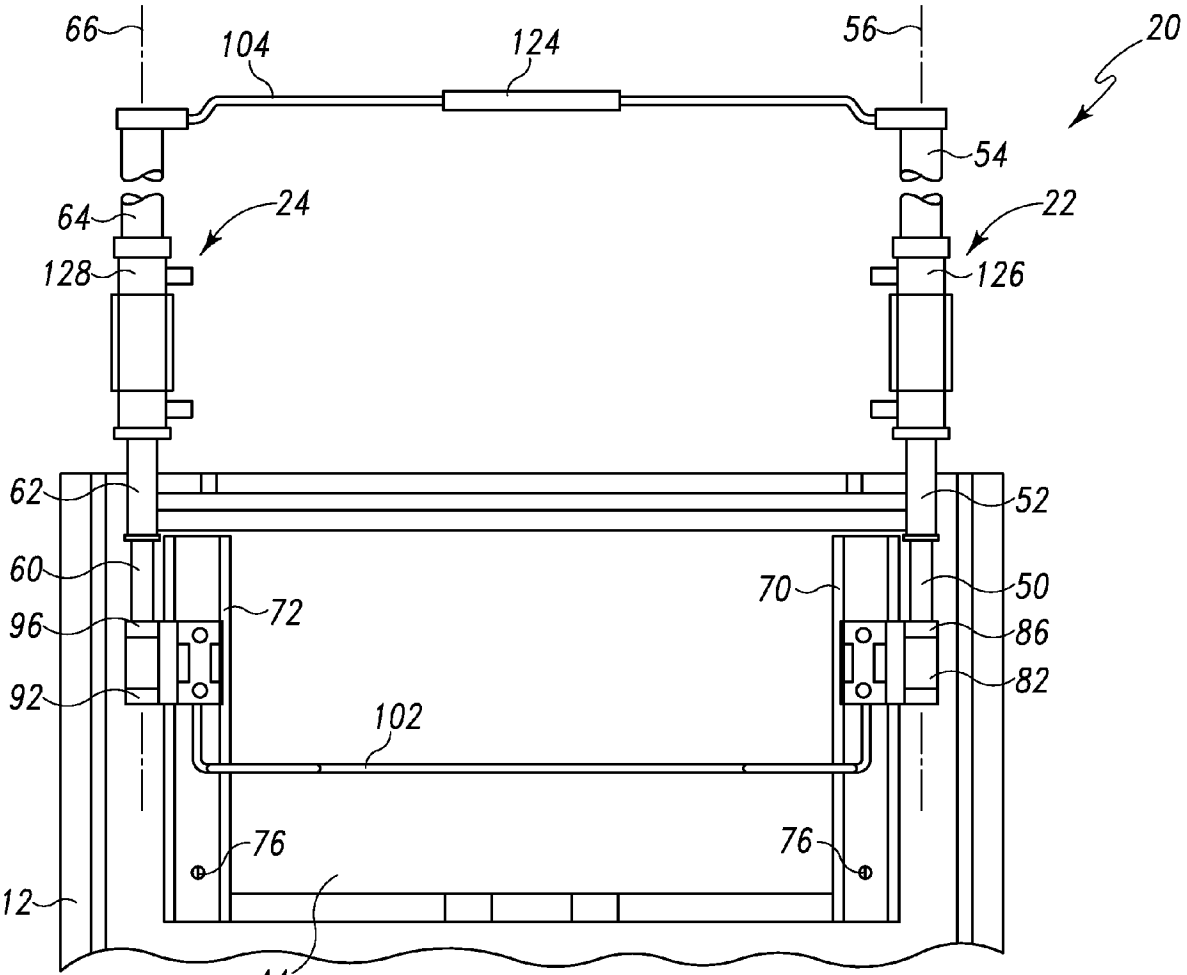
FIG. 4 is a bottom elevation view of the slide assembly, note the dish rack has been removed for clarity of description.

The right cylinder assembly 22 includes three telescoping hollow, cylindrical, metal rods 50, 52, 54, although embodiments with fewer (i.e., two) or more rods are contemplated for use depending on the needs of a given design. As can be seen in FIG. 4, the rod 50 has the smallest diameter and is received into the other two rods 52, 54. The rod 52 of the next largest diameter is received into the rod 54 with the largest diameter. As can also be seen in FIG. 4, since the rods 50, 52, 54 telescope with one another, they share a common cylindrical axis 56. In other words, the cylindrical axis of each of the rods 50, 52, 54 are collinear and hence share a common line 56.

The left cylinder assembly 24 is identical in construction and hence also includes three telescoping hollow, cylindrical, metal rods 60, 62, 64, although embodiments with fewer (i.e., two) or more rods are contemplated for use depending on the needs of a given design. As can be seen in FIG. 4, the rod 60 has the smallest diameter and is received into the other two rods 62, 64. The rod 62 of the next largest diameter is received into the rod 64 with the largest diameter. As can also be seen in FIG. 4, since the rods 60, 62, 64 telescope with one another, they share a common cylindrical axis 66. In other words, the cylindrical axis of each of the rods 60, 62, 64 are collinear and hence share a common line 66. As can be seen in FIG. 4, the cylindrical axis 66 of the rods 60, 62, 64 of the left cylinder assembly 24 and the cylindrical axis 56 of the rods 50, 52, 54 of the right cylinder assembly 22 are parallel with one another.

Figure 5:
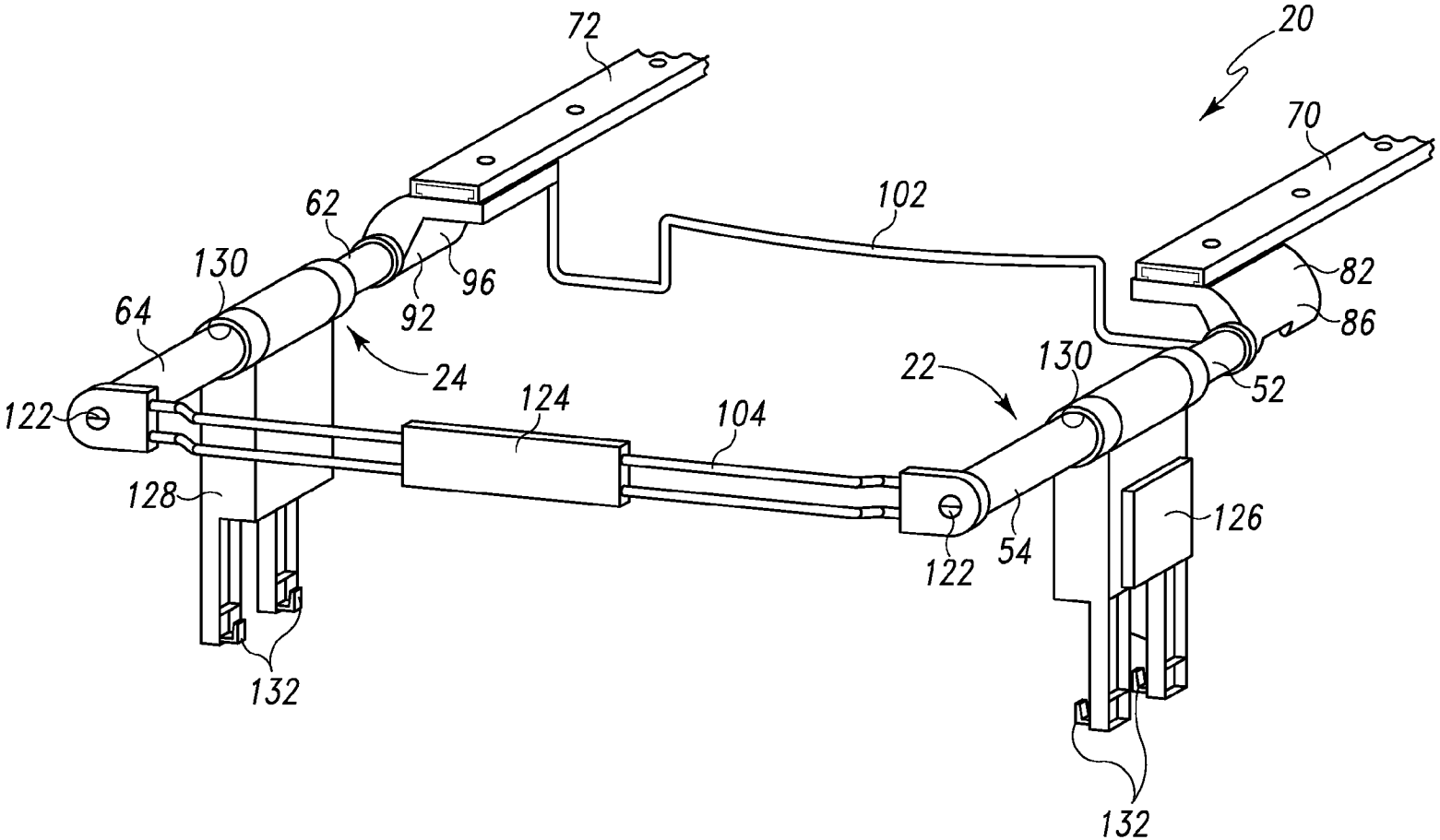
FIG. 5 is a perspective view of the slide assembly positioned in its retracted position.
Figure 6:
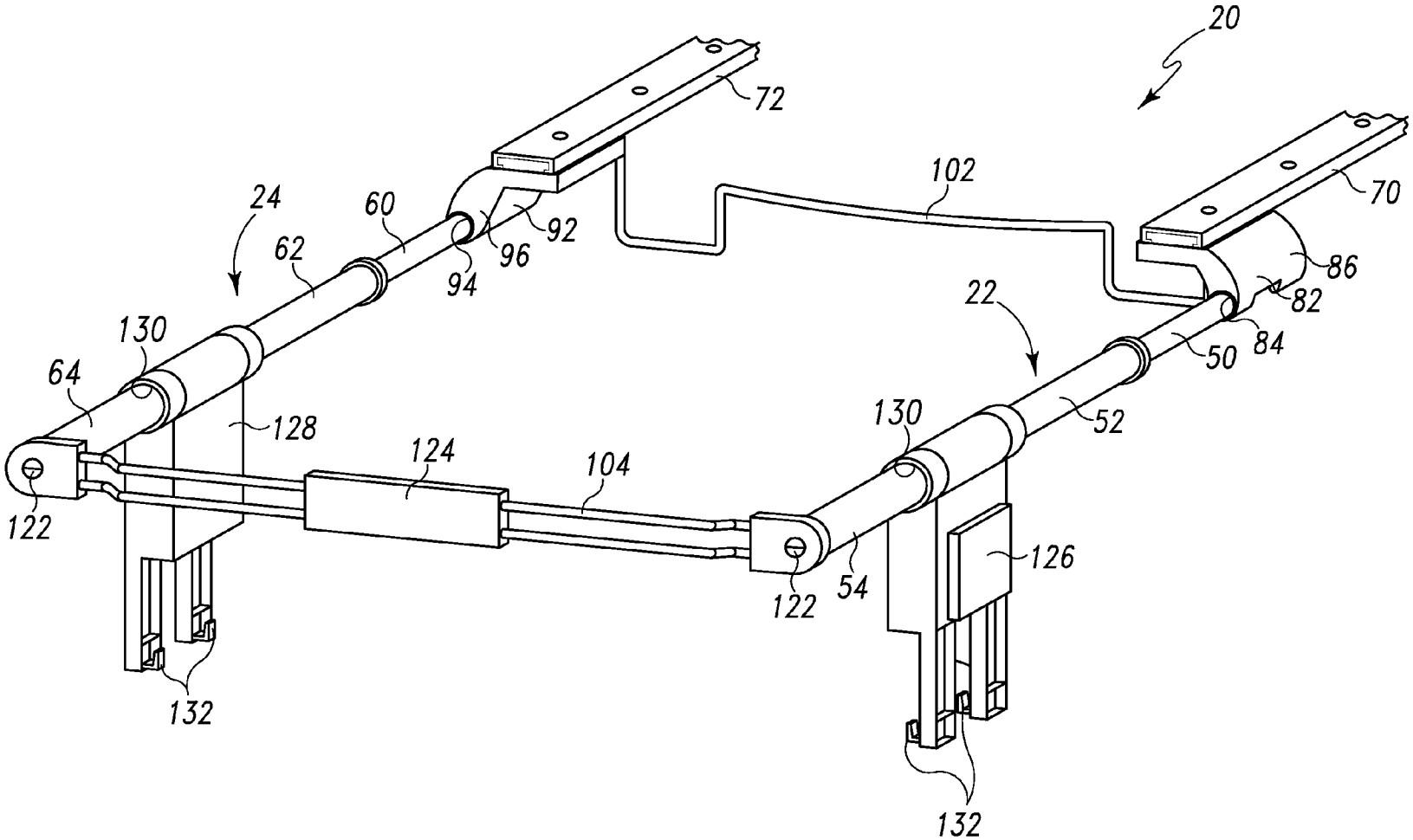
FIG. 6 is a perspective view of the slide assembly positioned in its extended position.

As can be seen best in FIGS. 4-6, a pair of guide rails 70, 72 are secured to the top wall 44 of the tub 12. A pair of reinforcement bars 74 are positioned on the outside of the tub 12. The right guide rail 70 is secured to one of the reinforcement bars 74 via a number of fasteners 76 such as screws or bolts, with the left guide rail 70 being secured to the other reinforcement bar 74 in the same manner. A metal strap 78 mechanically ties the back end of the reinforcement bars 74 to one another, with the front end of the reinforcement bars 74 being mechanically tied together by the dishwasher's collar 80.

As can be seen in FIGS. 4-6, a carrier 82 is positioned in the right guide rail 70. The carrier 82 is free to slide back and forth within the guide rail 70. The right cylinder assembly 22 is secured to the carrier 82. Specifically, the free end of the rod 50 is welded or otherwise secured within a bore 84 formed in a downwardly extending flange 86 of the carrier 82. On the other side of the slide assembly 20, a carrier 92 is positioned in the left guide rail 72. Like its counterpart, the carrier 92 is free to slide back and forth within the guide rail 72. The left cylinder assembly 24 is secured to the carrier 92. In particular, the free end of the rod 60 is welded or otherwise secured within a bore 94 formed in a downwardly extending flange 96 of the carrier 92.

The rear of the slide assembly 20 is mechanically tied together by a rear brace 102. As can be seen best in FIGS. 4-6, one end of the rear brace 102 is welded or otherwise secured to the right carrier 82, with the other end of the rear brace 102 being welded or otherwise secured to the left carrier 92.

Figure 7:
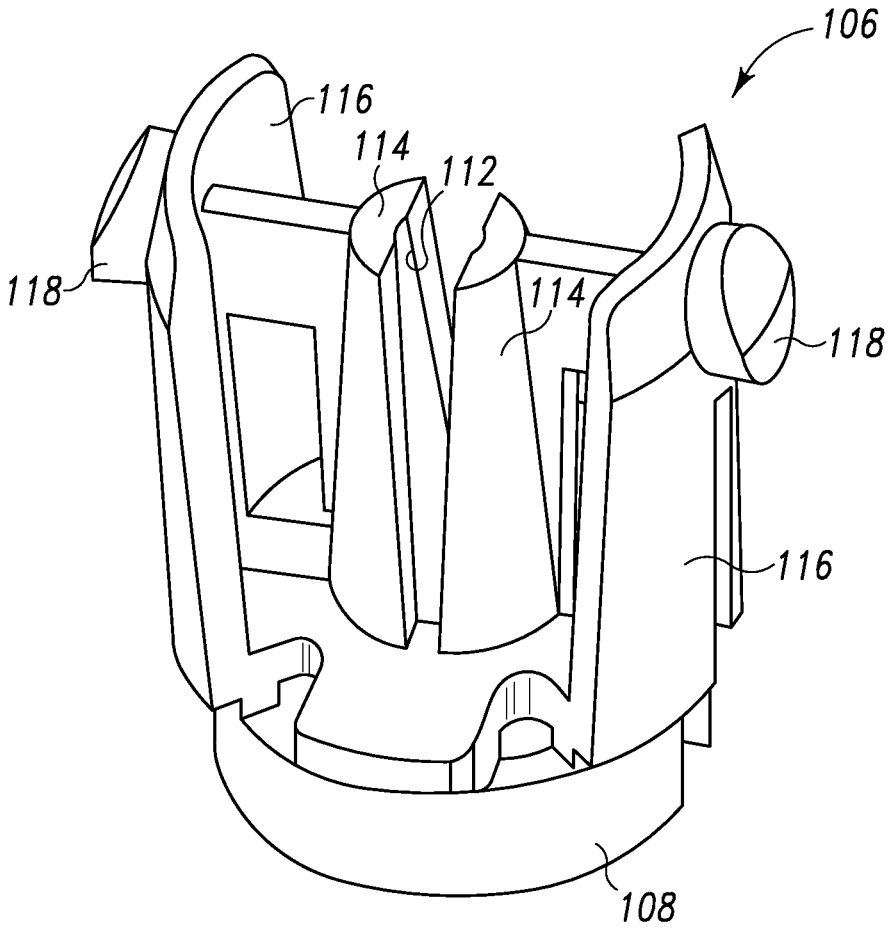
FIG. 7 is a perspective view of the anchor for securing the front brace to the cylinder assemblies.
Figure 8:
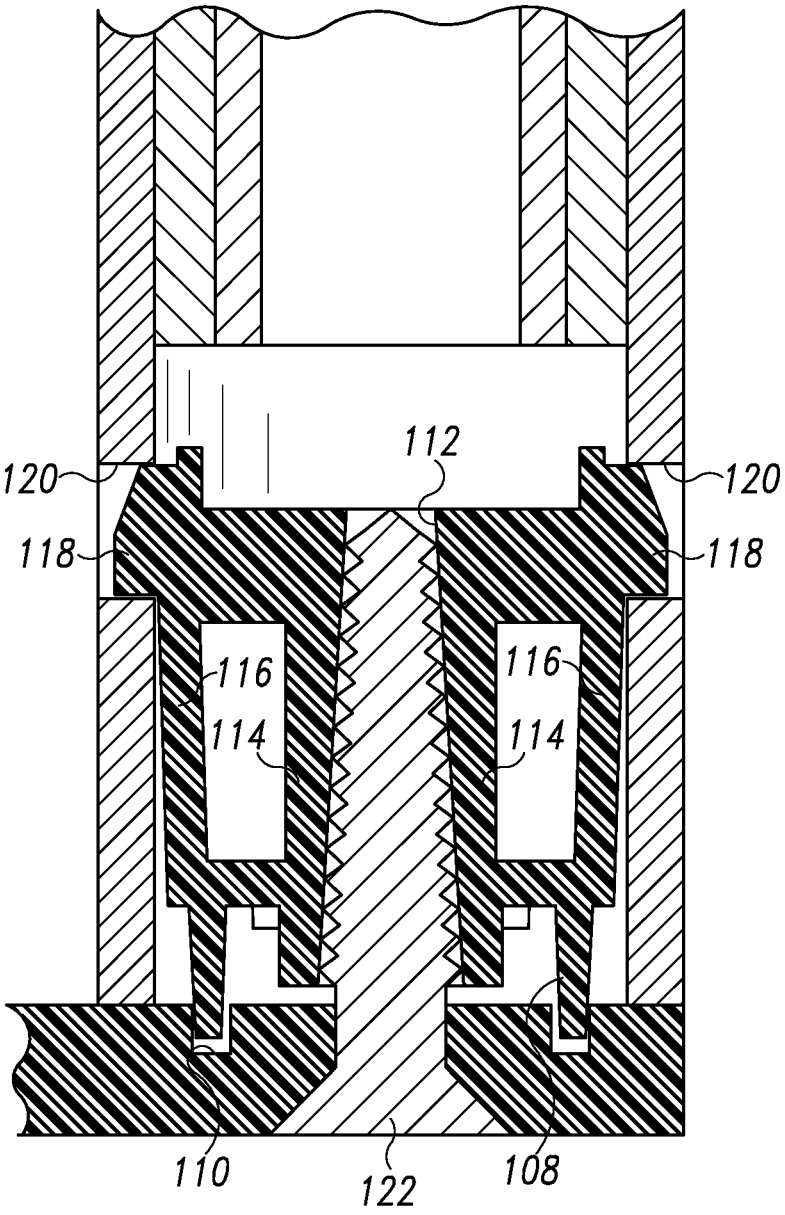
FIG. 8 is a fragmentary cross sectional view showing the front brace secured to the right cylinder assembly by the anchor.

The front of the slide assembly is mechanically tied together by a front brace 104. As can be seen in FIGS. 6-8, one end of the front brace 104 is secured to the outer end of the cylindrical rod 54, with the other end of the front brace 104 being secured to the outer end of the cylindrical rod 64. An anchor 106 is used to secure the front brace 104 to the outer ends of the cylindrical rods 54, 64. As shown in FIG. 7, the anchor 106 has an annular skirt 108 on one of its ends. The annular skirt 108 is received into an annular channel 110 formed on the end of the brace 104. A tapered bore 112 extends through the center of the anchor 106. The side walls 114 which form the tapered bore 112 extend outwardly away from the bore 112 and intersect a pair of resilient flanges 116. Both of the resilient flanges 116 have a cylindrical protrusion 118 extending outwardly from their outer surfaces.

As shown in FIG. 8, the cylindrical protrusions 118 are positioned in a pair of correspondingly sized holes 120 formed in the outer end of the of the cylindrical rod 54 (although only the cylindrical rod 54 is shown in FIG. 8, the cylindrical rod 64 is identical in construction). A screw 122 is inserted through a hole formed in the end of the brace 104 and into the tapered bore of the anchor 106. As the screw 122 is driven into the anchor 106, it urges the side walls 114 (and hence the resilient flanges 116) outwardly away from one another. Such outward movement of the resilient flanges 116 locks the cylindrical protrusions 118 in the holes 120 formed in the outer end of the of the cylindrical rods 54, 64. Moreover, the screw 122 also firmly seats the annular skirt 108 of the anchor 106 in the annular channel 110 of the front brace 104.

It should be appreciated that the front brace 104 maintains the structural orientation of the slide assembly 20. In particular, as can be seen in FIG. 4, the cylinder assemblies 22, 24 are parallel with one another. The front brace 104 is secured in a perpendicular relationship to both cylinder assemblies 22, 24 thereby maintaining the parallel relationship of the cylinder assemblies 22, 24. This ensures smooth movement of the slide assembly 20 during extension and retraction of the cylinder assemblies 22, 24.

Although described herein as a pair of parallel wires secured to one another, the front brace 104 may take on other forms. For example, the front brace 104 may be embodied as a solid bar having one of its ends coupled the cylinder assembly 22, with its opposite end coupled to the cylinder assembly 24. Moreover, the front brace 104 may include a pair of end caps (not shown) to cover the screws 122.

As shown in FIGS. 2-6, the front brace 104 has a handle 124 secured thereto. The handle 124 may be used by a user to pull the slide assembly 20 (and hence the upper dish rack 16) out of the tub 12 or push it back into the tub 12.

As shown in FIG. 2, the dish rack 16 is secured to the slide assembly 20 by a pair of rack connectors 126, 128. An upper end of the rack connectors 126, 128 is secured to the cylindrical rods 54, 64, respectively. Specifically, the upper end of the rack connectors 126, 128 is cylindrically shaped with a bore 130 extending therethrough. The cylindrical rods 54, 64 extend through the bore 130 of the rack connectors 126, 128, respectively. The cylindrical rods 54, 64 fit snugly within the bore 130 to prevent movement of the rack connectors 126, 128 along the cylindrical rods 54, 64.

The lower end of each of the rack connectors 126, 128 includes a number of clips 132. The clips 132 of the right rack connector 126 clip onto the wire tines of the right side of the dish rack 16, with the clips 132 of the left rack connector 128 being clipped onto the wire tines of the left side of the dish rack 16. The clips 132 secure the dish rack to the rack connectors 126, 128 and hence the cylinder assemblies 22, 24 of the slide assembly 20. It should be appreciated that the rack connectors 126, 128 may be adjustable such that the position of the clips 132 may be raised and lowered relative to the cylinder assemblies 22, 24. This allows the dish rack 16 to be raised and lowered to accommodate cooking wares of different sizes.

In operation, a user may pull the dish rack 16 out of the tub 12 by grasping the handle 124 located on the front brace 104 and pulling it toward the user. This causes the outer rods 54, 64 of the cylinder assemblies 22, 24 to slide outwardly along the middle rods 52, 62, respectively. At the same time, the middle rods 52, 62 slide outwardly along the inner rods 50, 60, respectively, thereby extending the dish rack 16 outwardly. If the user continues to pull the handle 124, the carriers 82, 92 slide forward in the guide rails 70, 72, respectively, until they contact the front stop of the guide rails 70, 72 thereby further extending the dish rack 16 out of the tub 12. Because of the rigid construction of the slide assembly 20, even in this fully extended position, very little side-to-side and up-and-down movement (i.e., "play") is present on the dish rack 16.

To return the dish rack 16 to the tub 12, the user simply pushes the handle 124. This first causes the carriers 82, 92 slide backward in the guide rails 70, 72, respectively, thereby partially retracting the dish rack 16 into the tub 12. Once the carriers 82, 92 contact the back stop of their respective guide rails 70, 72, the outer rods 54, 64 of the cylinder assemblies 22, 24 slide inwardly along the middle rods 52, 62, respectively. At the same time, the middle rods 52, 62 slide inwardly along the inner rods 50, 60, respectively, thereby retracting the dish rack 16 into the tub 12.

It should be appreciated that the telescoping hollow rods of the cylinder assemblies 22, 24 may be sealed with one end of the assemblies 22, 24 having an air orifice and/or a needle valve. In such a manner, air could be drawn into and expelled from the cylinder assemblies 22, 24 to dampen movement of the dish rack 16.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. A dishwasher, comprising:

a tub defining a washing chamber, a first pair of cylindrical rods carried by the tub, the first pair of cylindrical rods comprising a first right rod and a first left rod, a second pair of cylindrical rods, the second pair of cylindrical rods comprising (i) a second right rod telescoped to the first right rod, and (ii) a second left rod telescoped to the first left rod, a third pair of cylindrical rods, the third pair of cylindrical rods comprising (i) a third right rod telescoped to the second right rod, and (ii) a third left rod telescoped to the second left rod, a right rack connector secured to the third right rod and a left rack connector secured to the third left rod, and a dish rack having a right side thereof secured to the right rack connector and a left side thereof secured to the left rack connector.

2. The dishwasher of claim 1, wherein:

a longitudinal axis of the first right rod is collinear with a longitudinal axis of the second right rod, and a longitudinal axis of the first left rod is collinear with a longitudinal axis of the second left rod.

3. The dishwasher of claim 1, wherein:

longitudinal axes of each of the first right rod, the second right rod, and the third right rod are collinear with one another, and longitudinal axes of each of the first left rod, the second left rod, and the third left rod are collinear with one another.

4. The dishwasher of claim 1, further comprising:

a pair of guide rails secured to a top wall of the tub, the pair of guide rails comprising a right guide rail and a left guide rail, and a right carrier positioned in the right guide rail so as to slide within the right guide rail, the first right rod being secured to the right carrier, and a left carrier positioned in the left guide rail so as to slide within the left guide rail, the first left rod being secured to the left carrier.

5. The dishwasher of claim 4, further comprising a cross brace secured to both the right carrier and the left carrier.

6. The dishwasher of claim 4, further comprising a cross brace secured to both the second right rod and the second left rod.

7. The dishwasher of claim 1, wherein the right rack connector includes a bore receiving the third right rod, with the right rack connector being prevented from moving relative to the third right rod, and the left rack connector includes a bore receiving the third left rod, with the left rack connector being prevented from moving relative to the third left rod.

8. A dishwasher, comprising:

a tub defining a washing chamber, a right tubular assembly secured to the tub, the right tubular assembly comprising a number of telescoping rods each of which has a longitudinal axis that is collinear with one another, a left tubular assembly secured to the tub, the left tubular assembly comprising a number of telescoping rods each of which has a longitudinal axis that is collinear with one another, wherein the right tubular assembly comprises three rods, and the left tubular assembly comprises three rods, a right rack connector secured to right tubular assembly, a left rack connector secured to the left tubular assembly, a pair of guide rails secured to a top wall of the tub, the pair of guide rails comprising a right guide rail and a left guide rail, a right carrier positioned in the right guide rail so as to slide within the right guide rail, the right tubular assembly being secured to the right carrier, and a left carrier positioned in the left guide rail so as to slide within the left guide rail, the left tubular assembly being secured to the left carrier, and a dish rack having a right side thereof secured to the right rack connector and the left side thereof secured to the left rack connector.

9. The dishwasher of claim 8, further comprising a cross brace secured to both the right carrier and the left carrier.

10. The dishwasher of claim 8, further comprising a cross brace secured to both the right tubular assembly and the left tubular assembly.

11. The dishwasher of claim 8, wherein the right rack connector includes a bore receiving one of the number of telescoping rods of the right tubular assembly, with the right rack connector being prevented from moving relative to the one of the number of telescoping rods of the right tubular assembly, and the left rack connector includes a bore receiving one of the number of telescoping rods of the left tubular assembly, with the left rack connector being prevented from moving relative to the one of the number of telescoping rods of the left tubular assembly.

12. A dishwasher, comprising:

a tub defining a washing chamber, the tub having a top wall, a pair of guide rails secured to a top wall of the tub, the pair of guide rails comprising a right guide rail and a left guide rail, a right carrier positioned in the right guide rail so as to slide within the right guide rail, a left carrier positioned in the left guide rail so as to slide within the left guide rail, a right tubular assembly secured to the right carrier, the right tubular assembly comprising a number of telescoping rods each of which has a longitudinal axis that is collinear with one another, a left tubular assembly secured to the left carrier, the left tubular assembly comprising a number of telescoping rods each of which has a longitudinal axis that is collinear with one another, and a dish rack having a right side thereof secured to the right tubular assembly and the left side thereof secured to the left tubular assembly.

13. The dishwasher of claim 12, wherein:

the right tubular assembly comprises three rods, and the left tubular assembly comprises three rods.

14. The dishwasher of claim 12, further comprising a cross brace secured to both the right carrier and the left carrier.

15. The dishwasher of claim 12, further comprising a cross brace secured to both the right tubular assembly and the left tubular assembly.

16. The dishwasher of claim 12, further comprising:

a rear cross brace secured to both the right carrier and the left carrier, and a front cross brace secured to both the right tubular assembly and the left tubular assembly.

17. The dishwasher of claim 12, further comprising:

a right rack connector secured to right tubular assembly, and a left rack connector secured to the left tubular assembly, wherein the right side of the dish rack is secured to the right tubular assembly through the right rack connector and the left side of the dish rack is secured to the left tubular assembly through the left rack connector.

18. The dishwasher of claim 17, wherein the right rack connector includes a bore receiving one of the number of telescoping rods of the right tubular assembly, with the right rack connector being prevented from moving relative to the one of the number of telescoping rods of the right tubular assembly, and the left rack connector includes a bore receiving one of the number of telescoping rods of the left tubular assembly, with the left rack connector being prevented from moving relative to the one of the number of telescoping rods of the left tubular assembly.

* * * * *